United States Patent [19]

Gardenier

[11] Patent Number: 5,067,228

[45] Date of Patent: Nov. 26, 1991

[54] APPARATUS AND METHOD FOR BLIND ATTACHMENT OF A LINER TO A POOL SUPPORT STRUCTURE

[75] Inventor: John Gardenier, Guilderland, N.Y.

[73] Assignee: Saratoga Spa & Bath Co., Latham, N.Y.

[21] Appl. No.: 521,335

[22] Filed: May 9, 1990

[51] Int. Cl.[5] ..... B23Q 3/00

[52] U.S. Cl. ..... 29/525.1; 29/464; 52/169.7

[58] Field of Search ..... 29/464, 453, 525.1; 52/198, 199, 105, 169.7

[56] References Cited

U.S. PATENT DOCUMENTS

| | | | |
|---|---|---|---|
| 3,689,985 | 9/1972 | Nies | 29/464 X |
| 3,744,198 | 7/1973 | Boassy | 52/169.7 X |
| 3,755,981 | 9/1973 | West | 52/169.7 X |
| 3,964,219 | 6/1976 | Hala | 52/105 |
| 4,368,229 | 1/1983 | Ariga | 29/464 X |
| 4,741,090 | 5/1988 | Monnier | 29/464 |

FOREIGN PATENT DOCUMENTS

| | | | |
|---|---|---|---|
| 0045228 | 4/1981 | Japan | 29/525.1 |

*Primary Examiner*—Timothy V. Eley
*Assistant Examiner*—C. Richard Martin
*Attorney, Agent, or Firm*—Schmeiser, Morelle & Watts

[57] ABSTRACT

A protocol and apparatus for blind securement of an opaque, water-impervious membrane to a flat fixed margin of a water containment system. Specifically, the invention teaches a method for securing a pool lining wrinkle-free to a fixed structure of the pool, such as a molded stair module. An apparatus is provided herewith for effecting the method of the invention and consists basically in a grommet, a tactile index in the form of detent-receptacle paraphernalia and a planar faceplate, having template definition. The faceplate-template is used to securely press the membrane against the grommet while engaging the detent-receptacle apparatus.

9 Claims, 2 Drawing Sheets

APPARATUS AND METHOD FOR BLIND ATTACHMENT OF A LINER TO A POOL SUPPORT STRUCTURE

BACKGROUND AND OBJECTS OF THE INVENTION

1. Field of the Invention

The instant invention relates to the attachment of a water-impervious, opaque membrane to a fixed margin of a water containment system and, particularly, to the method and apparatus for making the blind attachment of a pool liner to the margin of a pool structure such as a stair module.

2. Discussion of the Background Art

Most in-ground and practically all above-ground swimming and wading pool water containments employ a membranous liner of opaque vinyl. It is commonplace when installing the liner to a modular pool structure margin, such as a stair module edge, to first place sealing means, such as a grommet of rubber or suitable pliable synthetic, over a modular or structural margin that is to receive the liner thereover. Next, the liner is placed in position and some clamping means, often a faceplate, is used to secure the liner against the sealing means. Professional and aesthetic results, of course, demand that elements such as grommets (seals) and faceplates be pre-positioned on modular or structural elements before a mating of liner with receiving margin takes place. Thus, during most modern installations of liners, the installer need only assure that margins are prepared to receive the liner, then place the liner over the margin, locate the alignment holes in the liner-covered margin and install the faceplate fixing devices, usually screws.

A most persistent problem encountered during the aforementioned installation is how to align the faceplates with the pre-drilled holes of the margin liner receivers-the backing strips behind the module or structural margins. Most installers use an awl or pick which, when probing for receiving holes in the sealing means, poses the threat of an undesired liner piercing. Then too, many an awl or pick is dropped and a liner is inadvertently pierced. Thus, it may be readily concluded that elimination of the pick or awl type of tool will eliminate an annoying and sometimes costly problem. To do this, means and method are required to install a liner blindly, that is, without the necessity or probing for alignment (and securing) holes. The instant invention is disclosed and fostered as an expedient for solving the problem and eliminating the hazards heretofore described. It is felt that the invention is no more costly than present methods and apparatus and boasts a certain elegance and simplicity for which there exists a definite need.

SUMMARY OF THE INVENTION

The invention consists basically of method and apparatus that are used in a water containment structure which includes a preformed structural module, a membranous lining element and conventional securable faceplate attachment means for fixedly securing the liner to the module in a watertight configuration. One method of this invention comprises the process for securing, to a preformed structural module such as a plastic of fiberglass stair, the seal and faceplate attachment means so that it may be readily used in the field. A second method comprises the use of the invention seal and faceplate improvement, in the field, for the purposes of securing to the structural module the membranous lining element, generally composed of a vinyl or a similar flexible, opaque membrane. The apparatus comprising the invention improvement is the seal-acquiring faceplate attachment means, including a tactile indexing means for the faceplate which allows a blind installation of the lining element to the module in situ.

Since both methods deal with the apparatus, the apparatus shall be described briefly. It consists essentially in a grommet or flexible sealing means made of any flexible or compressible substance that will remain resilient and impervious to pool water (which contains mildly corrosive elements such as saline-bearing or chlorine-bearing liquids), and a securing or clamping plate. Thus for most swimming pool uses, any of the synthetic rubbers or rubber-like substances will suffice, such as silicone, Thiokol(tm), Neoprene(tm), or the like. The clamping plate, like the sealing means (or grommet) is, for all practical purposes, of a conventional type used in the industry and is called a faceplate. The improvement comprises the conversion of the faceplate to a template, that is, an elongate, essentially flat, planar strip of suitable material such as plastic or fiberglass that contains therein a plurality of in-line holes (or foramens), most of which are adapted to accept therein screws or other suitable anchoring means. Particular to this invention, at least one foramen at each end is of a slightly larger diameter than the anchor-receiving foramens and its function is to serve, in one embodiment, as a means for inserting, into the margin of the grommet or sealing means receiving structure, a peg which will then remain firmly implanted in the margin of the module and will serve as a tactile reference once the opaque liner is placed over it. Thus, the faceplate may be once again reoriented and placed in registry with the sealing means having the liner secured therebetween. Those of ordinary skill will readily recognize an alternate embodiment wherein the hole or detent-receiving means is placed in the margin of the structural module and the peg or detent is affixed to the underside of the seal faceplate. It is also conceivable that the peg or detent be placed on the module margin or on the seal means (to project therefrom) and the faceplate afforded a grooving, pitting or other suitable detent-receiving means. Irrespective of the actual physical configuration, the detent-in-pit (groove or receiver) arrangement provides the tactile index of the instant invention and completes the apparatus therefor.

Two methodologies exist for the employment of the instant invention apparatus: first, the method for adapting a modular structure to receive sealingly a membranous lining element; and second, the method used in the field (in situ) for permanently fixing the membrane to one or more structural modules by use of the apparatus previously installed according to the first of these methods. Relative to the method for installing the apparatus at the point of fabrication and prior to transportation, the sealing means (grommet) is aligned over the margin or edge of the module to which the membranous lining element is to be later attached. After permanent fixing of the sealing means, the foraminous faceplate-template of the instant invention is placed thereover in a position that it will occupy once permanent installation is effected. Next, multiple drillings are made through the in-line foramens and, particularly, the hole(s) proximate the end(s) of the faceplate-template. All borings or drillings are made through the sealing means and into the margin of the structural module, said margins having been properly formed or reinforced to act as receiving means for the lining and attachment screw or anchor elements. At the end foramens, or tactile indices, slightly larger borings are made and smooth, slightly elongate pegs are fixedly inserted into the boring holes. It can now be readily seen that, irrespective of the opacity of the membrane that is later passed over the grommet, the fixed detents (tactile indices) will protrude through (enough) so that the faceplate-template may be readily realigned; and the in-line foramens will reside directly over the series of in-line marginal drillings or borings that had been made during the module construction with incorporation of the instant apparatus. For the purposes of shipping, the faceplate-template is left in the position just described, that is, removably fixed over the sealing means areas with a cover plate or facia generally snapped over, or fitted to, the faceplate by cover edge disposition into grooves in the template lateral structure. Relative to the second method, that is in-field usage, the facia are removed, the screws or anchors are removed from the faceplate-templates and faceplate(s) are removed from over the sealing means. The membranous lining element is then placed over the module margins and the worker, without any tools other than a screw-driver is able to digitally reference the aforementioned indices and place therover the respective faceplate(s) without having to discern, generally through an opaque membrane, the location of the faceplate foramens relative to the modular marginal holes or anchoring points. The retaining screws or anchors may be inserted by hand, passing through the foramens of the faceplate(s) and through the previously punctured areas of the sealing means, into the screw or anchor holes of the modular margin(s).

DETAILED DESCRIPTION OF THE DRAWINGS

DETAILED DESCRIPTION OF THE PREFERRED EMBODIMENT

The methodology for employing the instant apparatus has been briefly, but sufficiently, detailed in the Summary of the Invention. For the sake of expediency, only the apparatus will be discussed in the ensuing paragraphs, sufficient disclosure of the methodology being attendant thereon and having been had at the Summary.

Figure 1A:
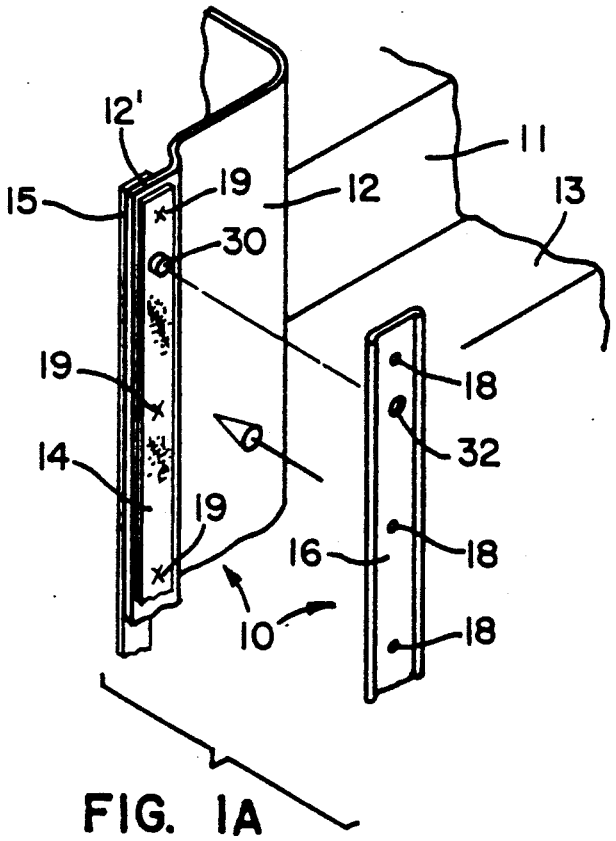
FIG. 1A is a partial isometric view of a pool stair module with an exploded detail of the instant invention.

Referring more particularly now to FIG. 1A, the invention 10 is disclosed in a exploded detail which accompanies the sectional isometric of a modular pool stair comprising a plurality of risers 11, treads 13 and stair sides 12. The stair margin 12' is the area which is to receive the apparatus of the instant invention. Not part of the instant invention, but as will quite often be required, margin 12' reinforcement block 15 is disclosed on the backside of the stair module side 12, directly underlying the marginal region 12'. The three salient parts of the instant invention, the grommet 14 (also termed sealing means), the faceplate-template 16 and the tactile index 30 are clearly shown. In the disclosed embodiment, tactile receiving means 32 comprises a slightly enlarged foramen relative to those in-line foramens 18 which will receive screws or anchors by which the faceplate-template 16 is secured over the grommet 14. The small X's of the face of the grommet 14 denote the subpoints of foramens 18 that constitute the anchor or screw seating positions.

Figure 1B:
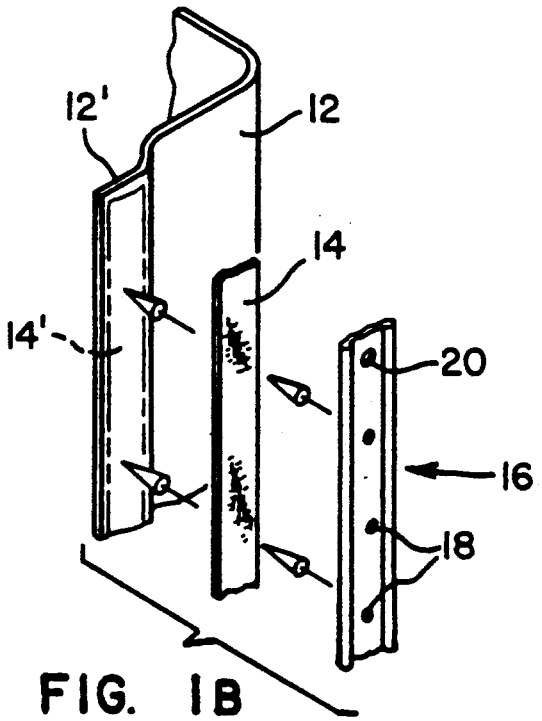
FIG. 1B is an exploded detail of the instant invention relative to a modular element margin.
Figure 1C:
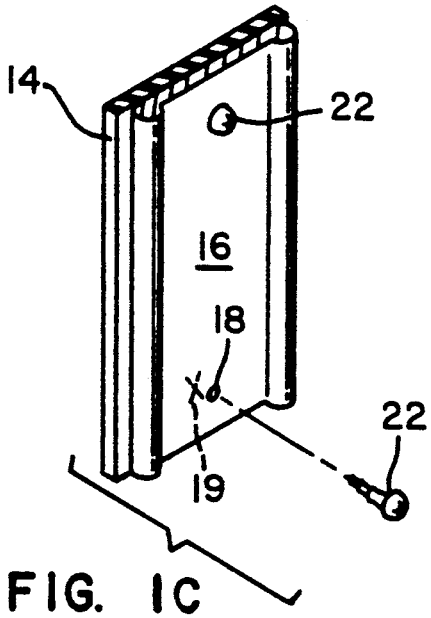
FIG. 1C is an isometric sectional view of the invention.

The isometric exploded detail of FIG. 1B adequately discloses the methodology for affixing the instant invention to the modular margin 12'. First, the grommet 14 is set to the margin 12' at the position 14' indicated. Thereafter, the faceplate-template 16 is set over the grommet and drillings or borings are made at foramens 18 and in the enlarged foramen(s) 20 which will serve as the repository(ies) of the tactile indicies. FIG. 1C shows the grommet 14 and faceplate 16 as it would be installed prior to shipping of the completed modular unit. Screws 22 are used in this instance to fix the faceplate-template 16 to the grommet and to the margin 12'. As noted in FIG. 1A, screw subpoint 19 is actually a perforation of the underlying grommet 14. It should be noted that the holes thus made in the grommet 14 constitute very little hazard to the violation of the grommet's integrity since the preponderance of seal material is untouched.

Figure 2:
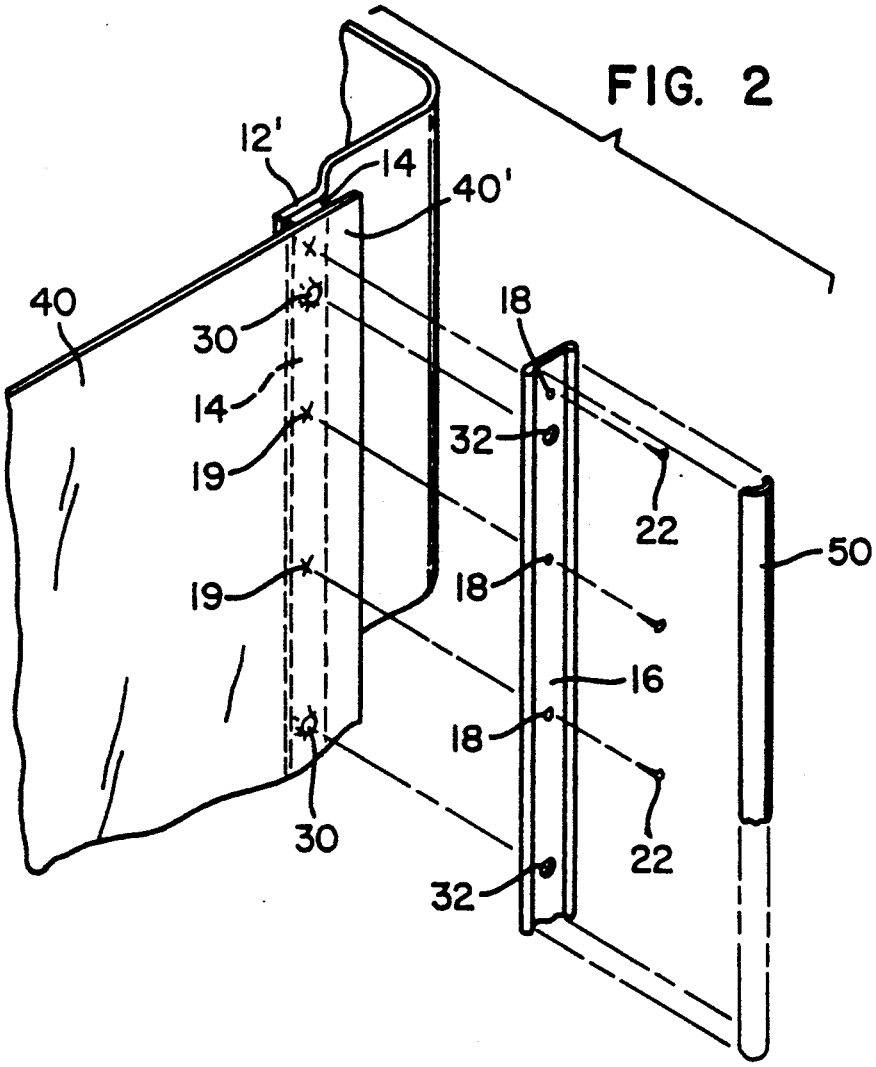
FIG. 2 is an isometric exploded view of the invention as set up and used in the field.

The reader's attention is now invited to FIG. 2, the final of these drawings, which shows in isometric exploded detail the fixation of the membranous liner 40 to a module margin 12' in situ. For the sake of clarity, the anchor or screw reinforcement means 15 has been eliminated from this illustration. It may be readily discerned that, once in the field, the cover or facia 50 is removed from the faceplate-template 16, screws 22 are removed and faceplate-template 16 is taken from over the grommet 14 areas. The modular unit or any portion of the water containment structure which is to receive the lining 40 has already been properly seated and fixed into its permanent position. The membrane 40 is then brought in contact with the marginal areas 12' that are to receive it and thus be finally sealed. Once the lining is properly placed over the marginal areas 12', the installer has but to feel for the location of the tactile indices 30 and place the corresponding faceplate-template 16 back into position over grommet 14. Screws 22 are immediately reinstalled and the wrinkle free fixture of the membrane is complete. After installation, the edges 40' of the membrane 40 are trimmed and facia 50 are reinstalled over the faceplate work surfaces.

It may be readily seen that the instant methodology and apparatus afford the pool installer a very thrifty expedient for installing a lining membrane, an expedient no longer fraught with the hazard of damaging the lining membrane or completing an ineffectual seal; the protocol and type of apparatus inculcated herein are applicable to a broad spectrum of water containment structures-liner attachments, and particularly with stair modules, drains, water inlets outlets, etc.. For example, in the case of a pool drain, the detent apparatus and the detent-receptical can be readily mechanized in the pool or spa drain by their inclusion in the base ring and corresponding cover plate, with the membrane directly over the hole (being) excised after final installation, as in the manner of the final trimming step taught herein relative to the liner-stair attachment. The instant apparatus and the techniques for its usage have potential for very broad use in any liquid containment system, whether above or below the ground; and, their application is limited only by the imagination of the user and the scope of the hereinafter appended claims

What is claimed is:

1. In a water containment structure including a preformed structural module, a membranous liner and faceplate sealing means for fixed securing of the liner to a protruding flat margin of the module in a water-tight configuration, an improvement for effecting a blind overlay installation of the faceplate sealing means so that it secures integrally the liner in said configuration, said improvement comprising a flat template strip having at least one detent-in-receptacle indexing pair means that is associated with an index compliment pair means disposed on the margin of the module; and fixing means for fixing said indexing pair means to said index compliment pair means with the liner secured therebetween.

2. The claim 1 invention wherein a detent of said detent-in-receptacle means comprises a smooth morphology so as to present a non-piercing shape to said liner.

3. The invention of claim 1 further defining a foraminous template strip that contains facia-engaging flanges for inserting therebetween a cover strip to cover essentially the strip.

4. A pool liner attachment apparatus for securely fixing a liner to a protruding, flat margin of a stair module, the system comprising:

a margin modification to provide a detent-in-receptacle alignment means to the margin, including detents and receptacles of said alignment means disposed along the margin;

a flat template, essentially narrow and elongate, bearing thereon detent-in-receptacle means that compliments detents or receptacles of said alignment means; and fixing means for securing said template to the margin modification with the liner disposed therebetween.

5. The apparatus of claim 4 wherein said detents comprise smooth, short projections.

6. The apparatus of claim 5 wherein said receptacles are holes.

7. The apparatus of claim 6 wherein said template bears a hole or projection array and said margin modification bears the projection or hole compliment of said template array.

8. A method for producing a pool liner blind attachment apparatus, the method comprising the steps of:

providing a narrow, flat and elongate strip which is to serve as a faceplate-template of the apparatus;

fixing removably, by suitable means, the strip over and onto a flat margin of a liner-receiving component or module;

penetrating the strip to form at least two spaced-apart holes in the strip and the underlying margin, thus modifying the margin and providing complimentary holes in both margin and strip; and permanently fixing shaped, smoothed dowels into the margin of strip holes to provide detents in whichever element, margin or strip, the detents are desired, the corresponding hole remaining, after said fixing, the detent compliment, whereby the strip may be removed, the liner laid over the margin and the strip realigned thereover by tactile reference on the two spaced-apart detent-hole pairs.

9. The method of claim 8 including the additional step of securing a gasket to the margin underlying the strip and, further penetrating the gasket simultaneously with the strip during said penetrating step.

* * * * *